US005601139A

United States Patent [19]

Remy

[11] Patent Number: 5,601,139

[45] Date of Patent: Feb. 11, 1997

[54] PROCESS AND MACHINE FOR MANUFACTURE OF AMORPHOUS METAL RIBBONS

[75] Inventor: Alain Remy, Chalon-sur-Saone, France

[73] Assignee: SEVA, Chalon-sur-Saone, France

[21] Appl. No.: 464,861

[22] PCT Filed: Jan. 11, 1994

[86] PCT No.: PCT/FR94/00028

§ 371 Date: Jul. 12, 1995

§ 102(e) Date: Jul. 12, 1995

[87] PCT Pub. No.: WO94/15738

PCT Pub. Date: Jul. 21, 1994

[30] Foreign Application Priority Data

Jan. 13, 1993 [FR] France ..... 93 00216

[51] Int. Cl.[6] ..... B22D 11/06

[52] U.S. Cl. ..... 164/463; 164/423; 164/429; 164/478

[58] Field of Search ..... 164/463, 479, 164/423, 429, 478

[56] References Cited

U.S. PATENT DOCUMENTS

| | | | |
|---|---|---|---|
| 4,150,706 | 4/1979 | Reiniche et al. | 164/423 X |
| 4,400,208 | 8/1983 | Ackermann | 75/129 |
| 4,408,653 | 10/1983 | Nienart et al. | 164/463 |
| 4,573,520 | 3/1986 | Fournier et al. | 164/253 |
| 4,982,780 | 1/1991 | Stepanenko et al. | 164/463 |

FOREIGN PATENT DOCUMENTS

| | | |
|---|---|---|
| 0009603 | 4/1980 | European Pat. Off. . |
| 0084335 | 7/1983 | European Pat. Off. . |

OTHER PUBLICATIONS

Patent Abstracts of Japan, vol. 14, No. 110, Feb. 28, 1990, JPA 1–313159 Published Dec. 18, 1989.

Patent Abstracts of Japan, vol. 12, No. 27, Jan. 27, 1988, JPA 62–183943 Published Aug. 12, 1987.

*Primary Examiner*—J. Reed Batten, Jr.
*Attorney, Agent, or Firm*—Sughrue, Mion, Zinn, Macpeak & Seas

[57] ABSTRACT

A jet of liquid metal 42 is directed onto a fast-moving receiving surface 4 and reciprocal relative motion is caused between the receiving surface 4 and the jet 42 perpendicularly to the moving direction.

6 Claims, 3 Drawing Sheets

PROCESS AND MACHINE FOR MANUFACTURE OF AMORPHOUS METAL RIBBONS

BACKGROUND OF THE INVENTION

The present invention relates to a process for manufacture of amorphous metal ribbons in which at least one liquid metal stream is projected onto a receiving surface moving at high speed.

The work carried out since 1958 by Pol Duwez at the California Institute of Technology has led to knowledge of amorphous metal alloys, which are produced by very rapid cooling of a liquid phase, thereby making it possible to preserve the random, or amorphous, structure thereof. Indeed, in this way the temperature of the material is immediately reduced below a certain threshold, called the vitrification temperature, itself located at a temperature much lower than the solidification point at which crystallization begins.

One technique for manufacture of amorphous metal alloys consists of pouring a stream of molten metal onto a surface moving past at high speed, whose temperature is kept below or equal to ambient temperature. In this way, the liquid spreads over the surface in a film having a thickness of only several microns. Because this film is extremely thin and in intimate contact with a heat sink having a much larger volume, and since the metals possess high level of thermal conductivity, the metal cools and solidifies very rapidly, i.e., at a rate of approximately $10^6$ °C./second. The surface passing beneath the metal stream may be part of a disk, an endless belt, or a wheel. This surface may incorporate notches perpendicular to its direction of travel, in order to divide the films or ribbons into small segments.

The films or ribbons thus produced possess remarkable mechanical and magnetic properties. Accordingly, the alloys exhibit very high tensile strength, and their ductility is marked by excellent folding strength, thereby making it possible to achieve curvatures around a radius equal to approximately the thickness of the ribbon. They also possess weak magnetism; that is, they are magnetized and demagnetized with a very weak field. Patents Nos. EP-A-59 864, 84 335, and 84 785 are examples from the literature describing processes of this kind.

Industrial-scale production of amorphous metal ribbons poses special problems, since a consistent geometry and quality of the ribbons must be guaranteed over long periods of time.

SUMMARY OF THE INVENTION

The invention is intended to meet these requirements simply and economically.

To this end, the object of the invention is a process of the aforementioned type, characterized by the fact that an alternating movement perpendicular to said direction of travel is executed between the receiving surface and the metal stream.

In accordance with additional features:

the alternating movement is sinusoidal; and the relative center position of the receiving surface and of the stream is shifted over time.

The invention also relates to a machine designed to carry out a process such as that described above. This machine, which incorporates a crucible containing liquid metal and fitted with at least one outlet orifice, and a chamber containing a receiving surface and fitted with means for moving this surface at high speed opposite the outlet orifice, is characterized by the fact that it comprises motion-generating means designed to produce, between the outlet orifice and the receiving surface, an alternating movement perpendicular to the direction of travel of said surface.

According to other features of this machine:

said surface is the peripheral surface of a notched wheel, whose drive shaft passes through one wall of the chamber in a sliding configuration, and said motion-generating means comprise a frame, a plate guided in translational motion parallel to the wheel and supporting the drive shaft, which is attached axially to this plate, and first drive means configured to drive the plate in a back-and-forth motion in relation to the frame;

the crucible is mounted so as to be able to slide perpendicularly to said direction of travel on the upper wall of the chamber and above an elongated opening in this wall extending in the direction in which the crucible slides, and means are provided to move the crucible in an alternating motion in the direction in which it slides;

the machine further comprises shift means configured to modify the relative center position of the receiving surface and of the outlet orifice;

said shift means are alternating drive means having a cycle substantially shorter than that of said movement-generating means.

BRIEF DESCRIPTION OF THE DRAWINGS

Embodiments of the invention will now be described with respect to the attached drawings, in which.

DETAILED DESCRIPTION OF THE PREFERRED EMBODIMENTS

Figure 1:
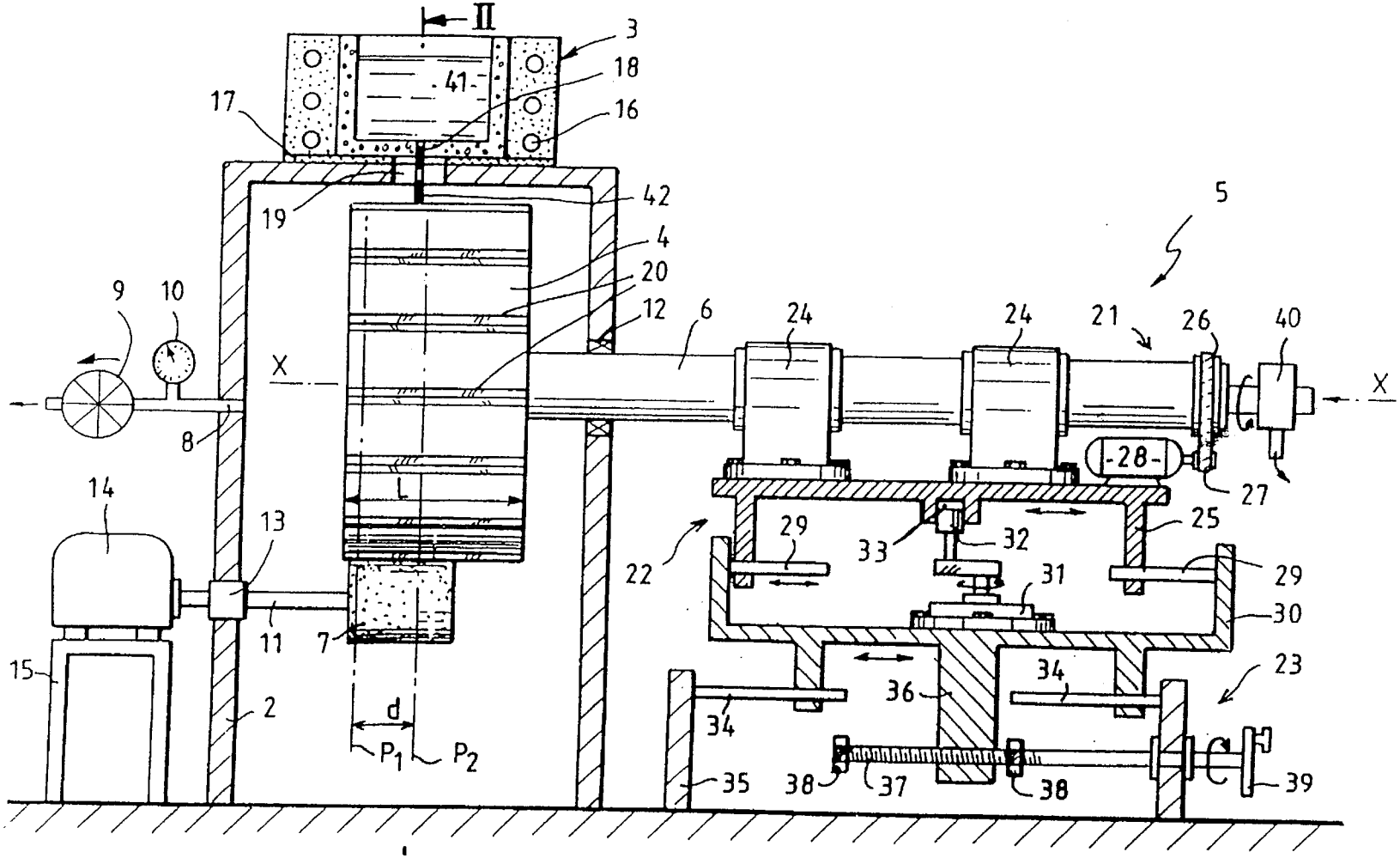
FIG. 1 is a schematic view in vertical cross-section of a first embodiment of the machine according to the invention.
Figure 2:
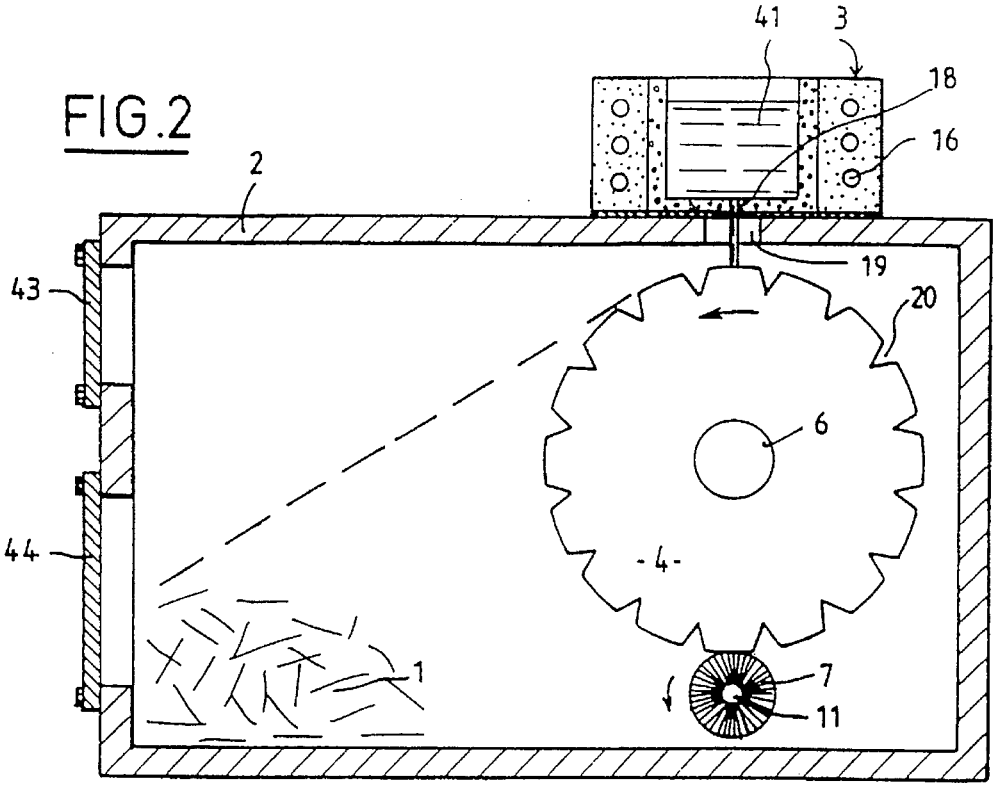
FIG. 2 is a vertical cross-section along line II—II in FIG. 1.

The machine illustrated in FIGS. 1 and 2 is designed to produce sections 1 of amorphous metal ribbon (FIG. 2). This machine basically comprises a chamber 2 containing a partial vacuum, a crucible 3, a notched wheel 4, means 5 for driving the shaft 6 of the wheel, and a brush 7 associated with the wheel.

The chamber 2 comprises a vacuum valve 8 connected to a vacuum pump 9 and equipped with a pressure gauge 10. The shaft 6 of the wheel and the shaft 11 of the brush 7 each pass through a lateral wall of the chamber, and sealing gaskets, 12 and 13 respectively, are inserted between the walls and the shafts. These two shafts are parallel, and the shaft 11 is driven by a motor 14 attached to a stationary frame 15 outside the chamber.

The crucible 3 is equipped with an inductor 16 and is attached to the upper wall of the chamber 2 with the interposition of a refractory joint 17. A pouring orifice 18 located directly above an opening 19 in the chamber is drilled in the bottom of the crucible.

The wheel 4 is a metal cylinder incorporating, on its outer surface, evenly-spaced notches 20 parallel to the axis X—X of the wheel. The brush 7 is in contact with the lower area of the wheel located in a straight line in relation to the opening 19.

The drive means 5 comprise a device 21 for driving the shaft 6 in rotation, a device 22 which drives the shaft in a back-and-forth movement, and a mechanism 23 designed to shift the mid-plane of the back-and-forth movement.

The shaft 6 is supported outside the chamber 2 by two bearings 24 fitted with axial stops (not shown) and fastened to a mobile plate 25. Accordingly, the shaft 6 is attached to the plate while allowing the translational motion thereof, and it holds a pulley 26 driven, via a belt 27, by a motor 28 attached to the plate 25.

The plate 25 is guided in translational motion parallel to the axis X—X by slides 29 attached to a mobile frame 30 positioned beneath the plate. This frame supports a geared motor 31, on the output shaft of which a cam 32 is fastened, the cam being engaged in a groove 33 perpendicular to the axis X—X and provided on the lower face of the plate 25.

The frame 30 is, in turn, guided in translational motion in relation to the axis X—X by slides 34 attached to a stationary frame 35 located beneath the frame 30. A lower extension piece 36 projecting beneath the frame 30 has a threaded hole in which is engaged a threaded shaft 37 fitted with two end-of-travel stop-motion devices 38. The extension of the shaft 37 is mounted so as to rotate in the frame 35, but is immobilized in translational motion in relation to said frame, and can be driven in rotation by a crank 39.

Moreover, the shaft 6 is hollow and forms a loop circuit for cooling water for the wheel, this circuit being connected to an internal wheel-cooling circuit (not shown). Water is supplied and evacuated by means of a rotating joint 40 placed at the end of the shaft.

This machine functions in the following manner.

Once a partial vacuum is created in the chamber 2 and the frame 30 is in a determinate position, the motors 14, 28, and 31 are started. The wheel 4 is thus actuated, on the one hand in rotation around its axis and, on the other, in an alternating sinusoidal motion along the axis. The wheel-cooling water is made to circulate.

Liquid metal 41 is then poured into the crucible 3, and flows at a determinate flow-rate through the orifices 18 and 19 in the form of a liquid metal stream or jet 42, which strikes the wheel 4. The rapid rotation of the wheel transforms the stream 42 into a flat ribbon, which the notches 20 cut into sections 1. Suitable adjustment of the parameters (diameter and speed of rotation of the wheel and flow rates of the liquid metal and cooling water) makes it possible to reach a metal-cooling rate of approximately $10^6$ °C./second, which, in conventional fashion, solidifies the metal in the desired amorphous form.

Because of the back-and-forth movement of the plate 25, the metal stream 42 strikes a variable area of the wheel, which moves between two vertical planes P1 and P2 spaced apart by a distance d equal to twice the distance between the cam 32 and its axis of rotation.

Experience shows that, because of this alternating movement, ribbon-reproducibility is improved, while wheel wear is reduced.

In addition, by operating the crank 39, the mid-plane of the area swept by the stream 42 can be shifted. In this way, wear of the wheel can be distributed evenly over its entire length and its useful life extended significantly. The amplitude of this movement, as determined by the stop-motion devices 38, is chosen so as to be slightly less than L–d/2, where L is the axial length of the wheel.

The crank 39 can be actuated intermittently by the operator, who monitors wheel wear through a window 43 (FIG. 2) installed in the front chamber wall. In a variant, control of the crank can be automatically programmed to be either intermittent or continuous. For example, operation of the crank can produce a sinusoidal movement of the frame 30 in accordance with a cycle much shorter than that of the motion of the plate 25.

When all of the liquid metal has been poured, the wheel is stopped, the vacuum in the chamber 2 is broken, and the sections of ribbon 1 are removed through a door 44 in the chamber (FIG. 2).

Figure 4:
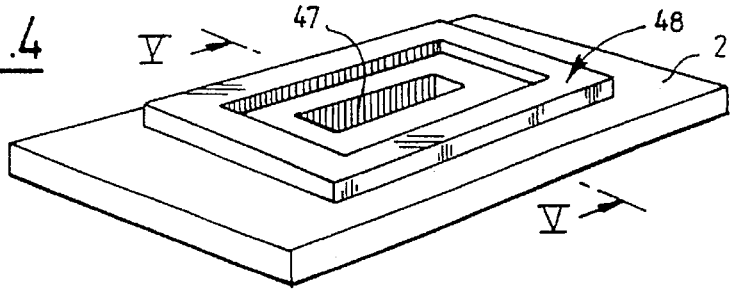
FIG. 4 is a perspective view of detail of the machine in FIG. 3.
Figure 5:
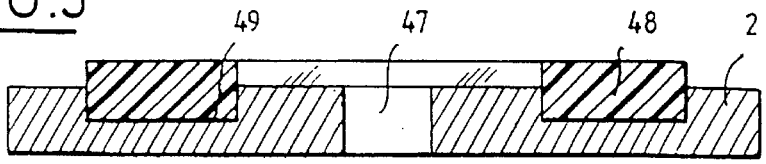
FIG. 5 is a cross-section along line V—V in FIG. 4.
Figure 3:
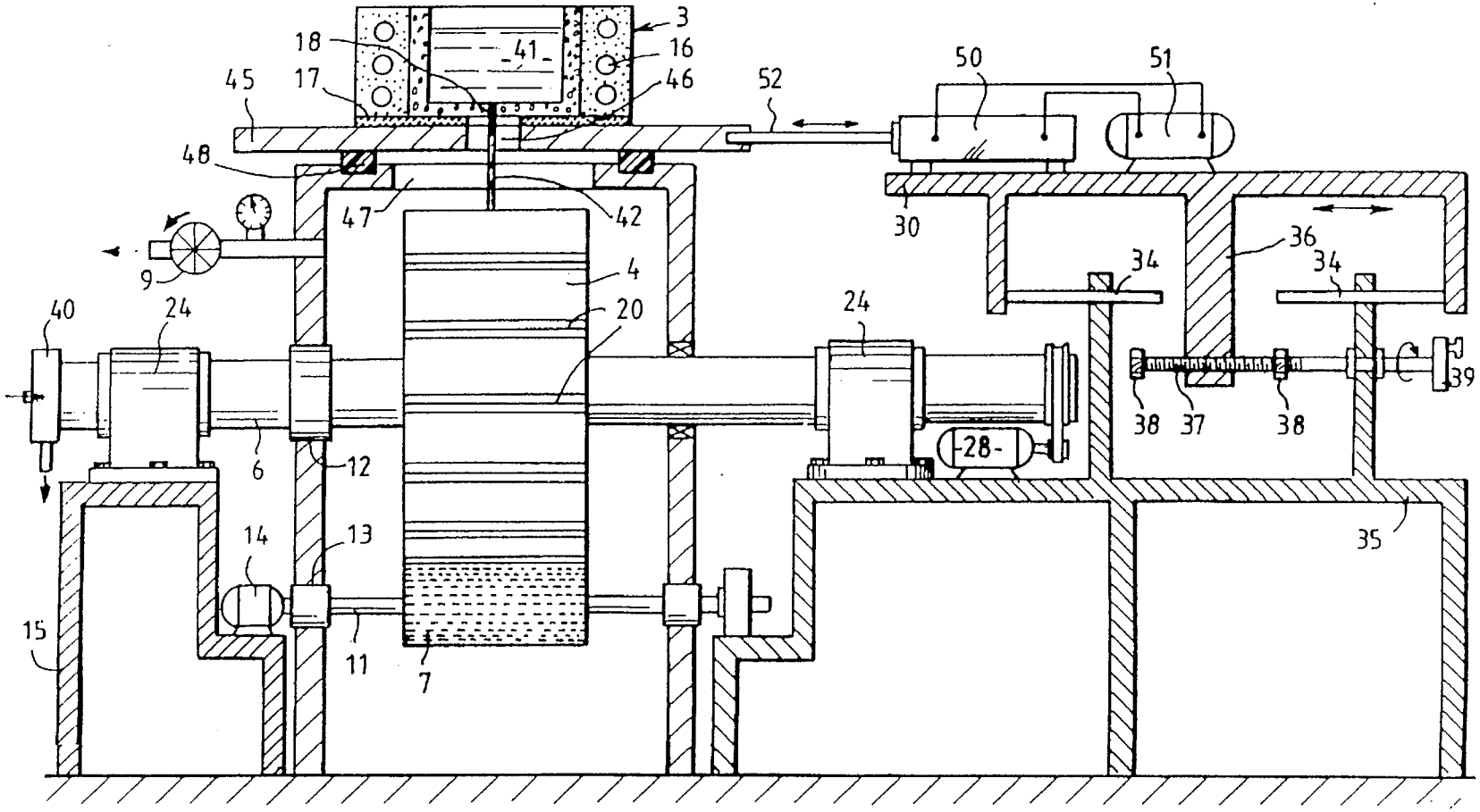
FIG. 3 is a view similar to FIG. 1, illustrating a second embodiment of the machine according to the invention.

In the embodiment in FIGS. 3 to 5, the shaft 6 is made axially stationary, and it is the crucible 3 which is mounted in a mobile arrangement parallel to the axis X—X and on the chamber 2. Moreover, in this embodiment the shafts 6 and 11 pass completely through the chamber 2.

Thus, the bearings 24 of the shaft 6 and the motor 28 are attached to the stationary frames 15 and 35, while the crucible 3 is set on an interposed joint 17 and attached to a support plate 45 incorporating a hole 46 positioned below the orifice 18. The upper wall of the chamber comprises an elongated slot 47 parallel to and plumb with the axis X—X, and a joint 48 made of polytetrafluoroethylene (PTFE, or Teflon) partially housed in a recess 49 extending around the slot. The plate 45 is placed on the joint 48 and guided in translational motion parallel to the axis X—X using slide-rails (not shown) provided on the upper chamber wall.

The mobile frame 30, which is associated, as before, with the slide-rails 34 and the threaded shaft 37/crank 39 unit, supports a servo jack 50 and a related control mechanism 51. The piston rod 52 belonging to this servo jack is attached to the plate 45.

This machine functions in the manner described above, with the exception that it is the stream 42 which is now shifted in relation to the wheel in accordance with a back-and-forth movement created by the servo jack 50 and with a slow shifting movement of the mid-point of this back-and-forth movement resulting from operating the crank 39.

The embodiment in FIGS. 3 to 5 may prove advantageous in some cases, e.g., when a wheel of considerable width is used.

In each of the embodiments of the machine, it is, of course, possible to produce, within the chamber, an atmosphere of a suitable gas, for example a neutral gas. Moreover, the crucible 3 may comprise several orifices 18 on the bottom thereof, in order to produce several jets 42 simultaneously.

I claim:

1. A process for the production of amorphous metal ribbons comprising the steps of:

a) projecting at least one stream of liquid metal (42) onto a receiving surface (4) moving at a high speed, b) simultaneously with step a), establishing a continuous reciprocating motion between said receiving surface and said stream of liquid metal in a direction perpendicular to a direction of movement of said receiving surface, and c) periodically shifting a relative center position of said receiving surface and said stream of liquid metal.

2. A process according to claim 1, wherein said reciprocating motion is sinusoidal.

3. A machine for the manufacture of amorphous metal ribbons comprising:

a) a crucible (3) containing liquid metal and having at least one outlet orifice (18), b) a chamber (2) containing a receiving surface (4) equipped with means (21) for moving said surface at a high speed below said outlet orifice, c) first shift means (22; 50–52) for producing, between said outlet orifice and said receiving surface, a continuous reciprocating motion perpendicular to a direction of travel of said surface, and d) second shift means (23) for periodically shifting a relative center position of said receiving surface and said outlet orifice (18).

4. A machine according to claim 3, wherein said surface is a peripheral surface of a notched wheel having a drive shaft (6) passing slidably through one wall of said chamber, and wherein said first shift means comprises a frame (30), a plate (25) rotatably supporting said drive shaft and guided on the frame in translational motion parallel to an axis (X—X) of the wheel, and drive means (31 to 33) for driving said plate in a back-and-forth motion in relation to said frame.

5. A machine according to claim 3, wherein said crucible (3) is mounted so as to slide on an upper wall of said chamber perpendicularly to said direction of travel of said receiving surface, above an elongated opening (47) in said upper wall extending in the direction of the reciprocating motion, and said first shift means (50 to 52) produces a reciprocating movement of said crucible in the direction in which it slides.

6. A machine according to claim 3, wherein said second shift means (23) has an operational cycle significantly shorter than that of said first shift means (22).

* * * * *